US005190183A

United States Patent [19]

McNaughton et al.

[11] Patent Number: 5,190,183

[45] Date of Patent: Mar. 2, 1993

[54] TRASH CAN DIVIDER

[75] Inventors: Patrick McNaughton, Minneapolis; Jamie McNaughton, Brooklyn Park, both of Minn.

[73] Assignee: McNaughton Incorporated, Minneapolis, Minn.

[21] Appl. No.: 818,055

[22] Filed: Jan. 8, 1992

[51] Int. Cl.[5] ..... B65D 90/04

[52] U.S. Cl. ..... 220/551; 220/23.83; 220/404; 220/909; 248/95; 248/907

[58] Field of Search ..... 220/404, 529, 530, 539, 220/540, 541, 543, 551, 552, 720, 909, 23.83; 248/95, 907; 206/315.6

[56] References Cited

U.S. PATENT DOCUMENTS

| | | | |
|---|---|---|---|
| 1,912,505 | 6/1933 | Weston | 220/552 |
| 2,161,624 | 6/1939 | Hoerr | 220/551 |
| 2,602,567 | 7/1952 | Goon | 220/541 X |
| 2,697,631 | 12/1954 | Miller | 220/543 X |
| 2,746,457 | 5/1956 | Musacchia | 220/543 X |
| 2,875,970 | 3/1959 | Gardner . | |
| 3,893,615 | 7/1975 | Johnson | 232/43.2 |
| 3,893,649 | 7/1975 | Cornell et al. . | |
| 4,750,638 | 6/1988 | Sosower | 220/404 |
| 4,834,253 | 5/1989 | Crine | 220/909 X |
| 4,834,262 | 5/1989 | Reed . | |
| 4,867,328 | 9/1989 | McCarthy . | |
| 4,905,853 | 3/1990 | Strawder | 220/404 X |
| 4,925,056 | 5/1990 | McCoig . | |
| 4,967,900 | 11/1990 | Gossett | 220/404 |
| 4,974,746 | 12/1990 | Dickinson . | |
| 5,085,342 | 2/1992 | Strawder | 220/404 |

*Primary Examiner*—Alan N. Shoap
*Assistant Examiner*—Stephen Cronin
*Attorney, Agent, or Firm*—Gregory P. Kaihoi

[57] ABSTRACT

An apparatus for dividing a trash receptacle into sections for the source separation of waste items and recyclable materials. The apparatus is designed to be attached to the top opening of a trash receptacle, and facilitates the use of liner bags placed within the sections to produce compartments for separating and storing the various types of trash and recyclables. The apparatus is adjustable to fit the top of variuos sizes of trash containers and is further adjustable in size, shape and the number of compartments it divides into without inhibiting the use of the container lid. The apparatus can be configured to divide the container into thirds, halves or one half and two quarters to facilitate the separation of recyclables.

11 Claims, 9 Drawing Sheets

TRASH CAN DIVIDER

FIELD OF THE INVENTION

The present invention relates to the disposal of household waste. More particularly, the present invention concerns means of sectioning a common household trash receptacle for facilitating the separation and collection of recyclable waste.

BACKGROUND OF THE INVENTION

In recent years, there has been dramatic increase in environmental awareness by the general population. As a result, more people are recycling today than ever before.

Most cities are implementing some type of program to collect recyclable materials from their residents. The residents in turn have to abide by the restrictions of the cities' programs which in most cases will call for "source separation" (separating out the recyclable materials at the point from which they are generated).

In response to the environmental concerns of the public, a variety of new products have been introduced. The proposed ideas for source separation include the following examples:

a. Plastic box container—A resident separates the recyclable materials in plastic or paper bags and puts the bags in the container. This option puts most of the responsibility for separating the materials in the resident's hands and the resident must find space to set up different bags around the house. The container is only a means by which the recyclable materials are taken to the curbside for pickup by the city and does not assist in the actual separation process.

b. Tubular frames—This approach consists of a network of plastic tubes that connect together to make a rectangular or square frame. In some cases, the rectangular frame is subdivided into thirds or fourths producing smaller frames within the larger one. Plastic bags may be hung with clips on the frame, resulting in separate compartments. While this device addresses the separation issue, the resident is still required to find sufficient space to locate the structure, and the apparatus can be relatively expensive to manufacture.

c. Trash organizer—This method, e.g., illustrated by U.S. Pat. No. 4,750,638, consists of a plastic extendable divider placed across the opening of a trash can, thus dividing the can into two compartments. As most recycling programs require recyclable materials to be separated into at least three categories (plastic, glass, aluminum), this application is limited in its versatility. Furthermore, the device requires tools for installation.

d. Rigid Sub-Compartments—This concept, depicted in U.S. Pat. No. 4,834,253, involves the use of a custom designed outer container adapted to allow several smaller, rigid "sleeves" to be inserted within its walls, thereby dividing the larger container into several sub-compartments. To remove the recyclable materials, the entire container is disassembled by removing the sleeves. The recyclable material is then dumped out of the container. This device is rather costly and is not very flexible.

e. Crowns or lids—Devices that fit in this catagory (such as U.S. Pat. No. 4,967,900) typically include a fixture that fits upon the top circumferential rim of the trash can. The fixtures are pre-configured to divide the trash can into predetermined sections through a plurality of fixed arms. Trash cans have different sized rims, however, and, as this device is not adjustable, the fixtures must be custom made for each different size and configuration of trash can, a costly prospect. In addition, the fixture does not allow the size of the compartments to adjust to the consumer's specific accumulation of the various recyclable items. Furthermore, the fixture typcially inhibits the use of the trash can's lid.

A need exists, therefore, for a trash receptacle divider that is inexpensive and easy to use, is versatile enough to allow the consumer to adjust the number of sections produced in the trash receptacle and the size of the individual sections, and which also fits most commonly found household trash cans.

SUMMARY OF THE INVENTION

The present invention relates to a trash receptacle divider for creating recycling compartments within a common household trash can. The divider is comprised of telescopic arms, a connector, end clips and liner clamps. The telescopic arms allow the divider to adjust to a variety of trash can sizes and shapes while the connector permits the user to set up a number of different sizes of compartments. The divider is thus versatile, inexpensive and requires no tools for installation and does not inhibit use of the regular trash can lid.

DETAILED DESCRIPTION OF THE INVENTION

Figure 1:
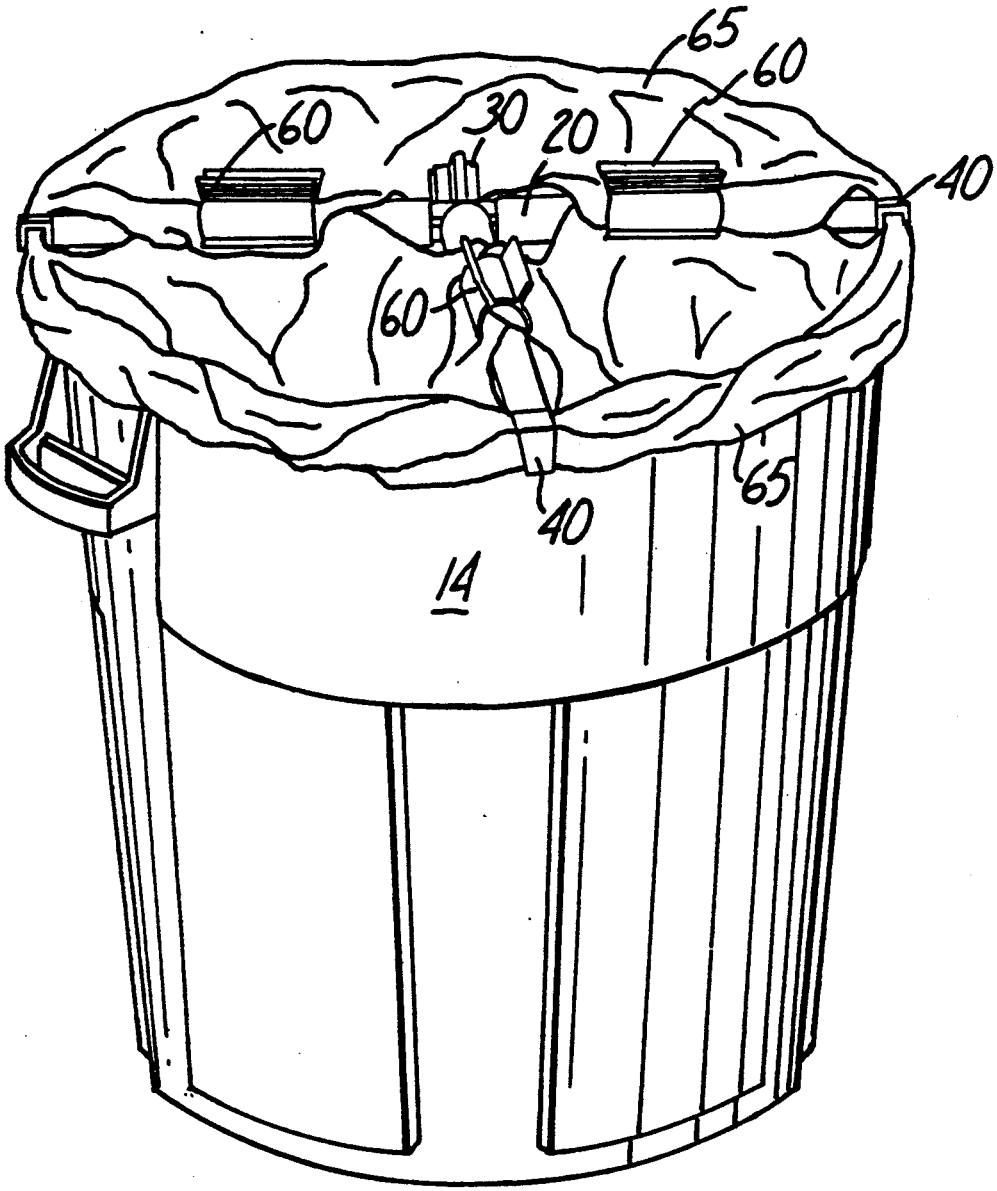
FIG. 1 is a perspective view of the invention installed on a trash can in one of its possible configurations.

The trash can divider of the present invention, generally designated, includes telescopic arms 20, a connector 30, and end clips 40. The arms 20 preferably are adjustable in length to allow the divider 10 to be adaptable to most sizes and shapes of trash cans.

In a preferred embodiment, the arms 20 are comprised of an internal member 22 and an external member 24. The internal member 22 is desirably of the same general cross-sectional area and of dimensions slightly smaller than that of the external member 24. Such a configuration allows the internal member 22 to reside within the external member 24 while being free to extend outward by sliding over the external member 24. By slidably extending the internal member 22 outwardly from the external member 24, the distance across the divider 10 can be varied to accomodate trash receptacles of various sizes.

In the preferred embodiment, both arm members 22, 24 are generally circular in cross-section with the outside diameter of the internal member 22 being approximately equal to that of the inside diameter of the external member 24. In the preferred embodiment, the external member 24 is typically 6¼ inches in length and the internal member 22 five inches in length. This desirable structure allows the arms to be adjustable between 13 inches (including the central connector 30) and 24 inches.

Figure 2:
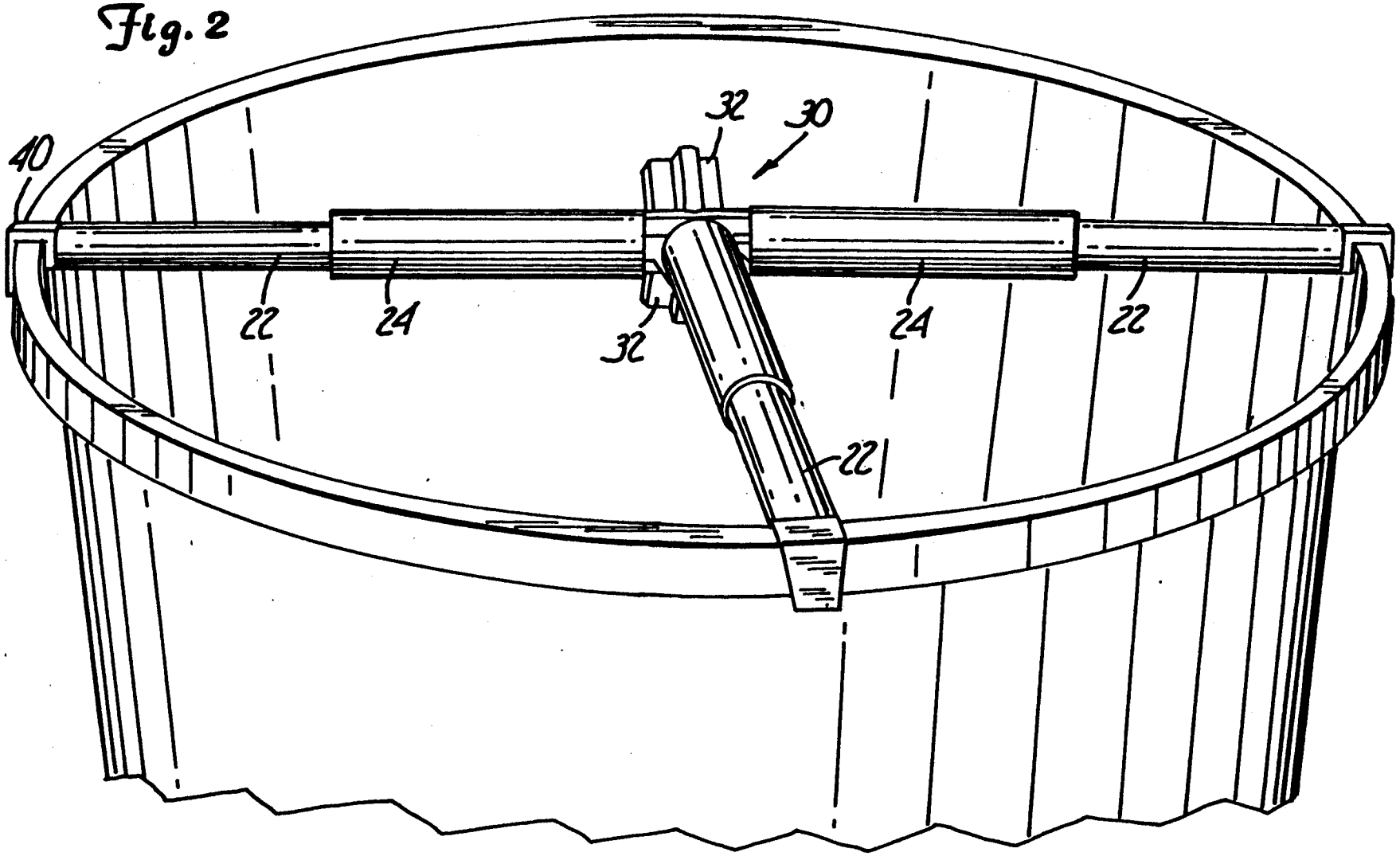
FIG. 2 is a perspective, partially broken-away view of the invention in the configuration shown in FIG. 1 without the trash can liners.
Figure 3:
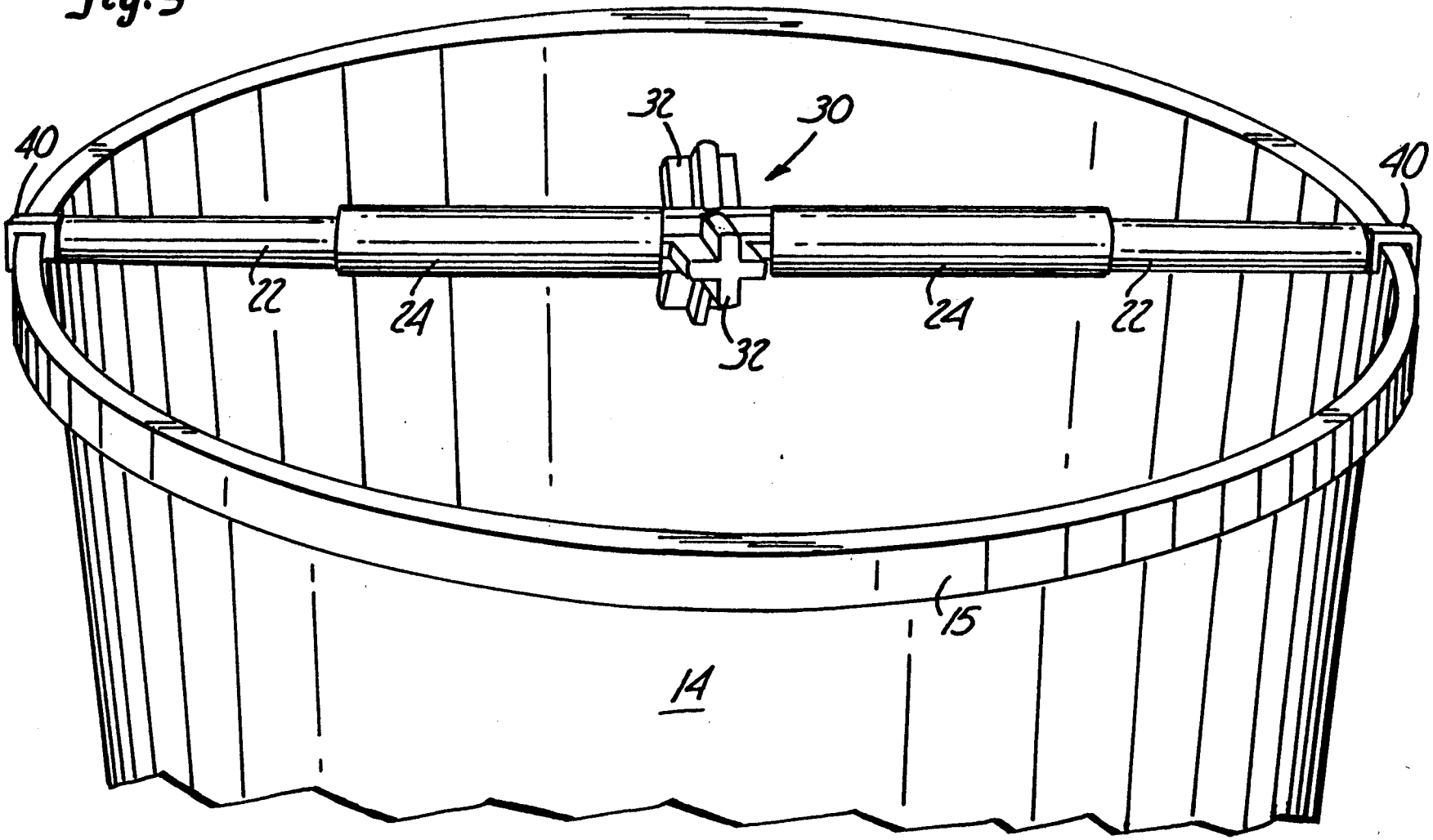
FIG. 3 is a perspective, partially broken away view showing another configuration of the invention.
Figure 4:
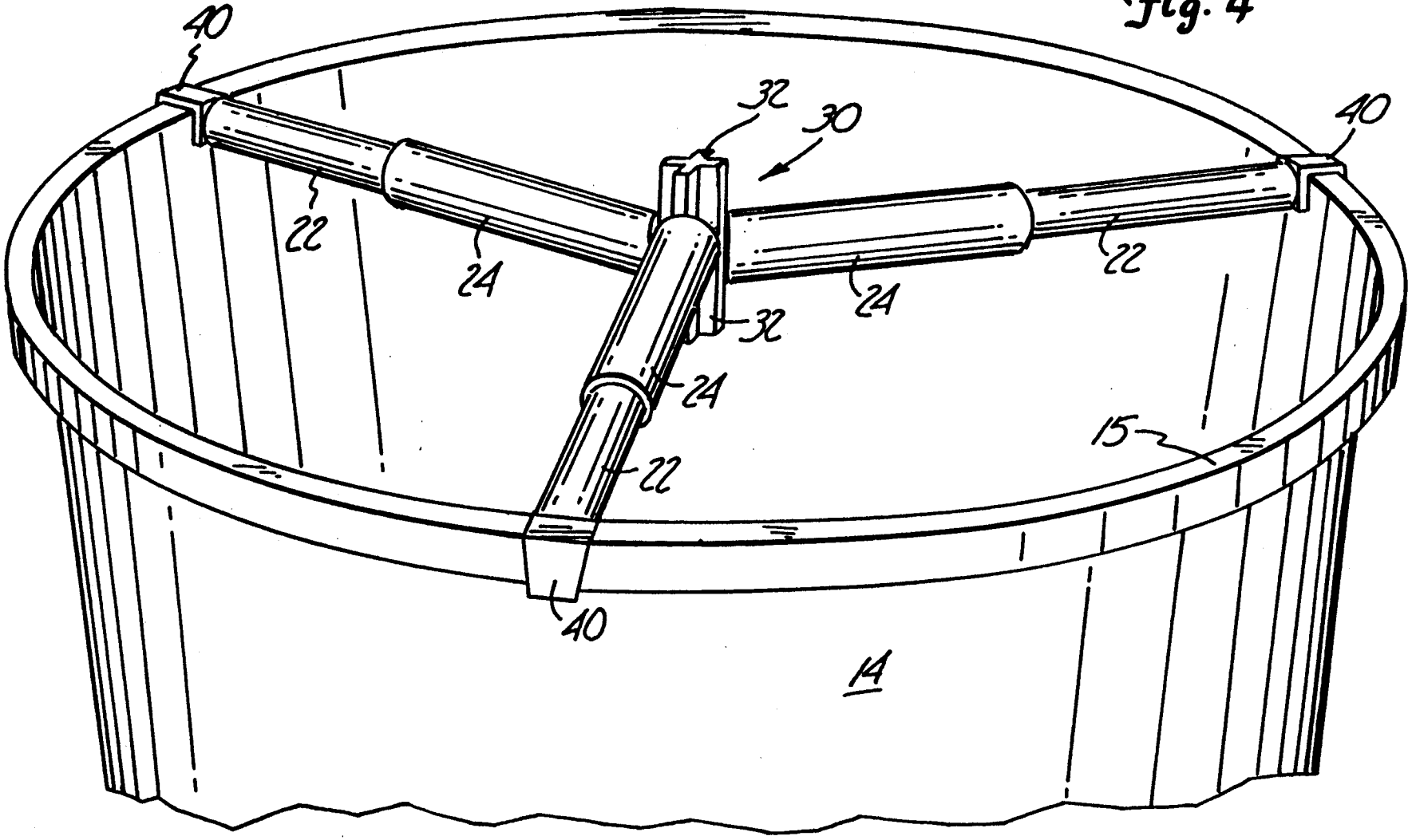
FIG. 4 is a perspective, partially broken-away view showing another configuration of the invention.

Referring to FIGS. 2–4, the arms 20 are supported by a central connector 30 which is desirably located near the center of the opening of the trash can 14. The connector 30 contains attachment means for securing and supporting the arms 20. Any suitable attachment means may be used to secure the arms 20 to the connector 30, however, in the preferred embodiment (illustrated in FIGS. 5–7), the connector 30 contains male type plugs 32 which are insertable into corresponding female-type receiving ports 34 located on the end of the external members 24 of the arms 20.

Figure 5:
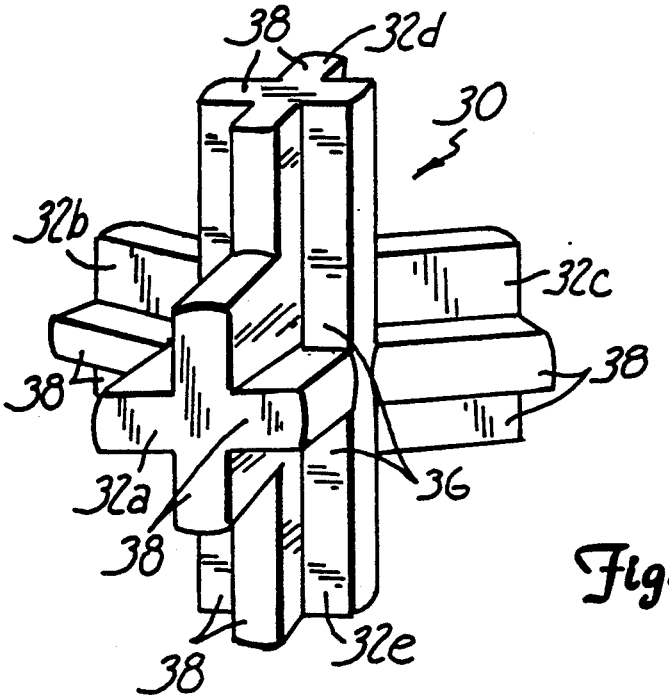
FIG. 5 is a perspective view of the connector of the invention.
Figure 6:
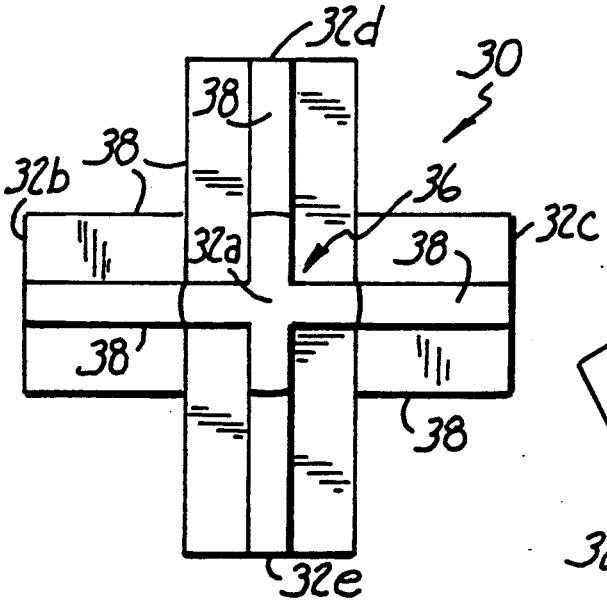
FIG. 6 is a side view of the connector of the invention.
Figure 7:
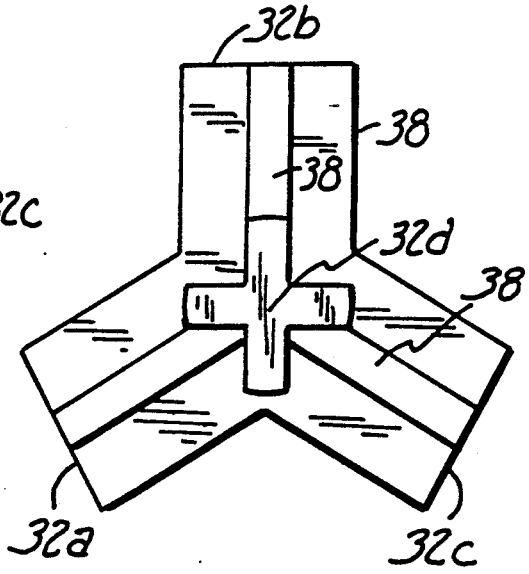
FIG. 7 is a top view of the connector of the invention.
Figure 8:
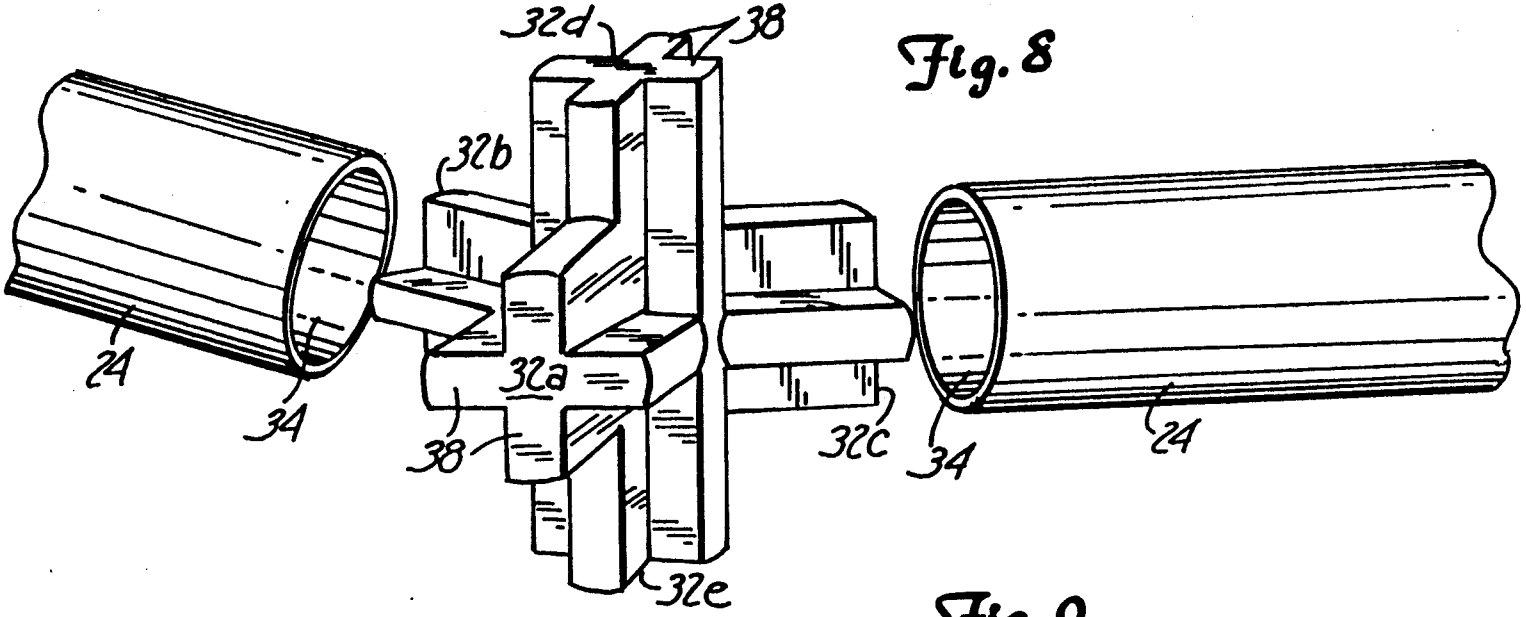
FIG. 8 is a perspective, exploded view of the connector and telescopic arms of the invention.
Figure 9:
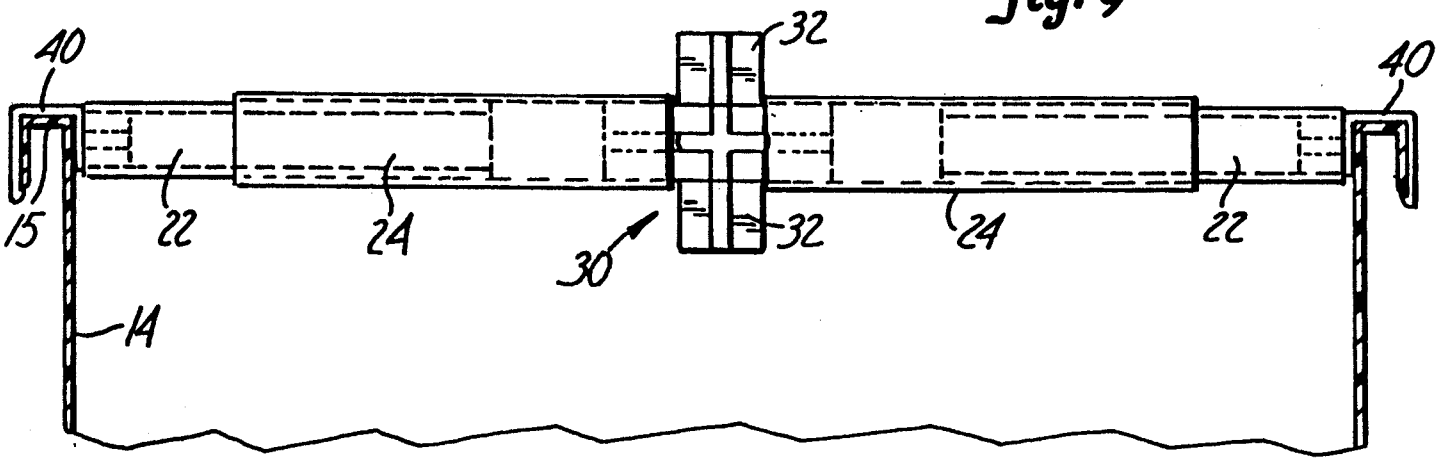
FIG. 9 is a side view in partial cross section of the configuration of FIG. 3.

In the preferred embodiment shown in FIGS. 5–7, the connector 30 is a three-dimensional figure with five plugs 32 extending outwardly from the center of the connector 30. Three of the plugs 32*a* are located in the same plane and are spaced around the connector's core 36 an equal distance from each other (i.e., 120° from one another). The two other plugs 32*b* are located on opposite ends of the core 36. The plane of the core intersects the plane containing the three plugs at a generally perpendicular angle so that the distance from a core plug 32*b* to any of the other plugs 32*a* is constant.

Figure 17:
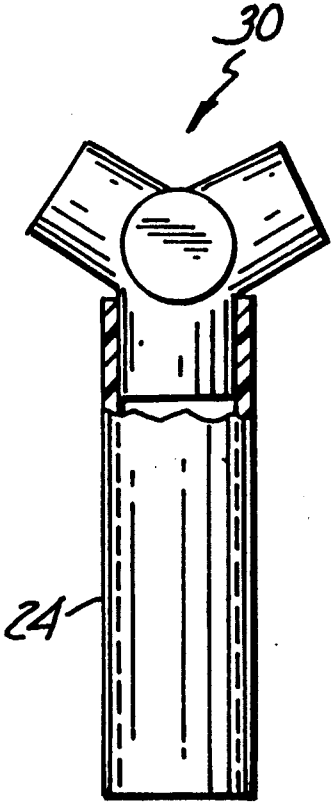
FIG. 17 is a cross-sectional view of the connector of the invention having male-type plugs with one of its male-type plugs inserted into the female-type receiving port located at the second of an external number.
Figure 16:
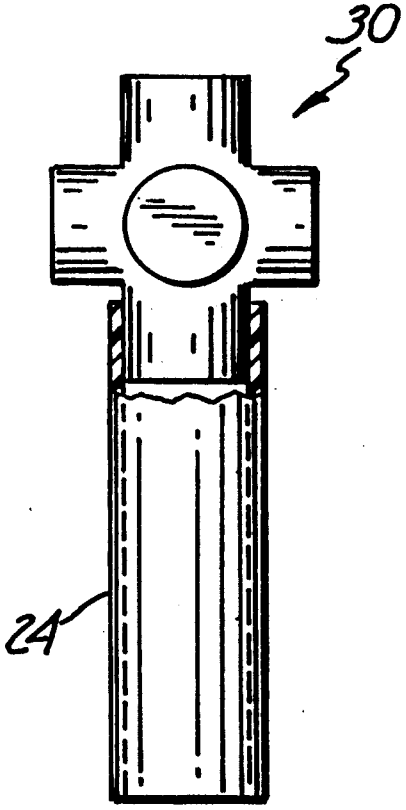
FIG. 16 is a cross-sectional view of the connector of the invention having male-type plugs with one of its male-type plugs inserted into the female-type receiving port located at the second end of an external member.

Each plug 32 is desirably identical. Any suitable design can be employed. FIGS. 16–17 illustrate schematically generally round plugs; however, in the preferred embodiment (FIGS. 5–7), the plugs 32 consist of two generally perpendicular walls 38 which intersect at their centers to form a raised X. The distances between the ends of each wall 38 is desirably equal to that of the inside diameter of the external member 24 of the arm 20 so that the receiving port 34 fits snugly upon the plug 32.

Figure 18:
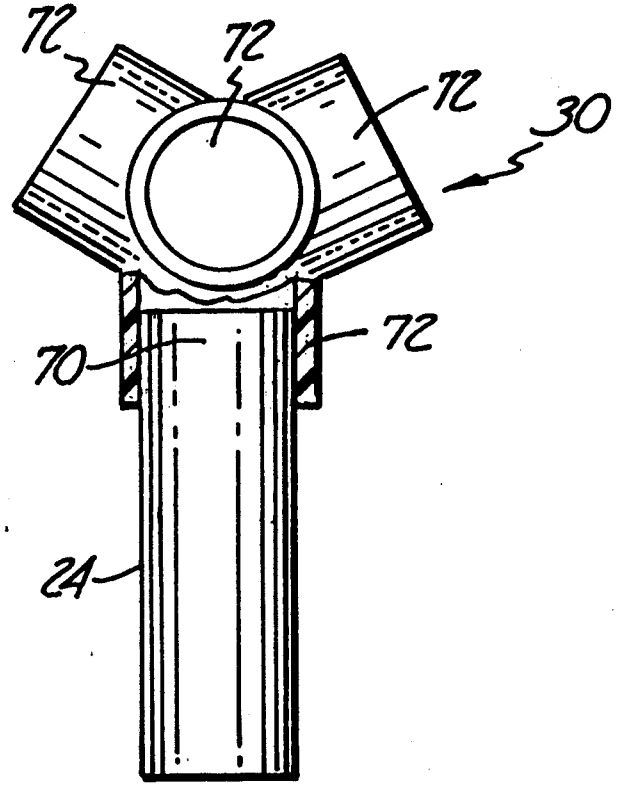
FIG. 18 is a cross-sectional view of a female receiving connector having receiving ports into which a male extension arm is inserted.

In an alternate embodiment shown in FIG. 18, the male plugs on the connector 30 and the female receiving ports on the arm 20 are reversed so that the now male extension arms 70 fit into the now female receiving connector 72.

Figure 11:
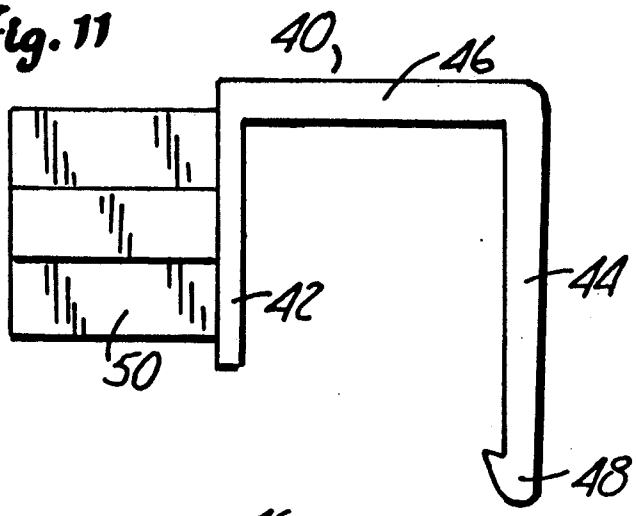
FIG. 11 is a side view of the end clip.
Figure 10:
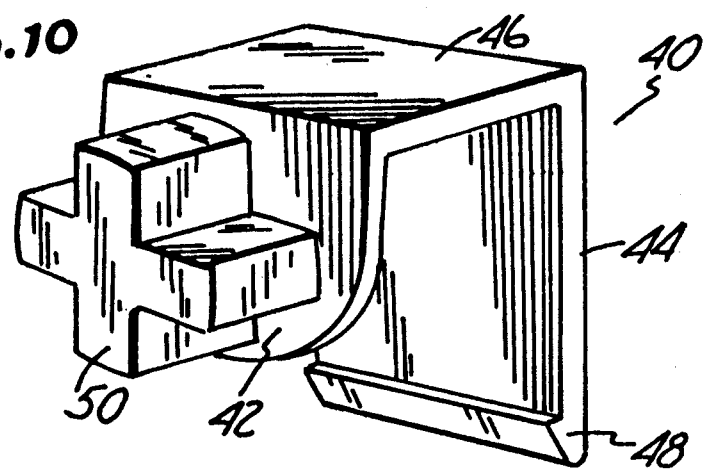
FIG. 10 is a perspective view of the end clip of the invention.
Figure 12:
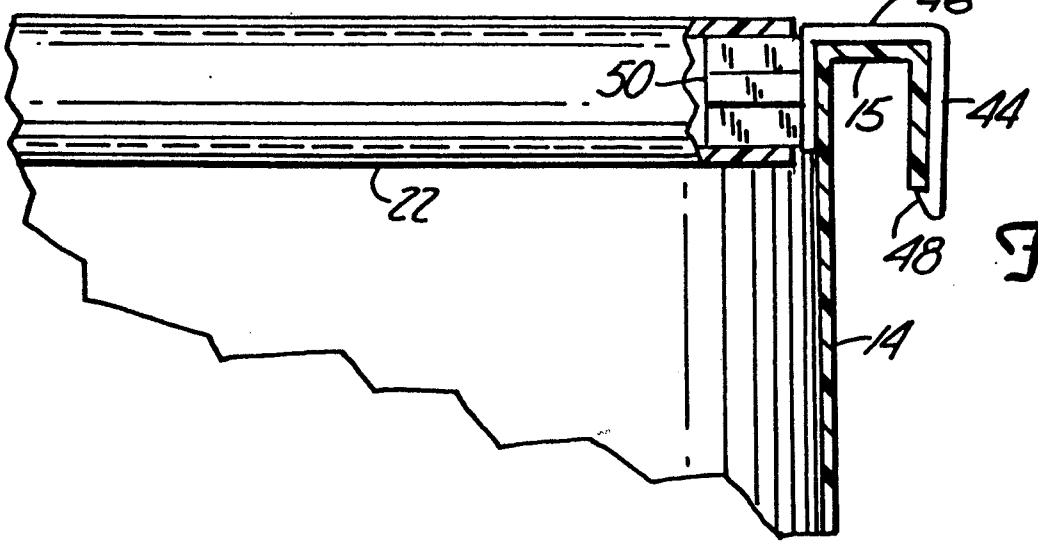
FIG. 12 is a side view in partial cross section of the end clamp installed in the arm and clipped over the rim of the trash can.

Referring now to FIGS. 10–12, located at the end of the internal member 22 of the arm 20, opposite the connector 30, are end clips 40 for attaching the arms 20 to the trash can rim 15. The clips 40 are desirably comprised of a smaller vertical wall 42, a horizontal wall 46 and a larger vertical wall 44 attached together to form an inverted U shape. The clip 40 is desirably formed to enhance its securing ability. This can be achieved in a variety of ways, and, in the preferred embodiment, the large vertical wall 44 is slightly tapered toward the small vertical wall 42. A lip 48 is desirably located at the bottom of the large vertical wall 44 to enhance the securing ability of the clip 40. The small profile of the end clip 40 allows the lid of the trash receptacle to be used even when the divider 10 is in place.

In the preferred embodiment, a male plug 50 is carried by the clip 40 on the small vertical wall 42 as a means of attaching the clip 40 to the internal member 22 of the arm 20. Also in the preferred embodiment, the plug 50 is generally shaped similarly to those on the connector 30 except that the length between the ends of the walls corresponds to that of the inside diameter of the internal member 22 of the arm 20 so that the plug 50 fits securely onto the end of the internal member 22.

In an alternate embodiment, the male plugs 50 on the clip 40 are switched with the female receiving ports 28 on the arms 20.

Figure 13:
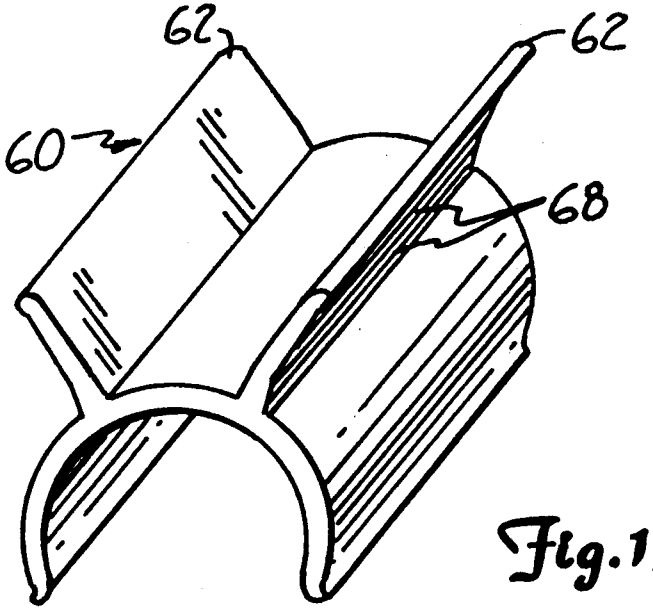
FIG. 13 is a perspective view of the clamp used to hold liners on the arms of the invention.
Figure 15:
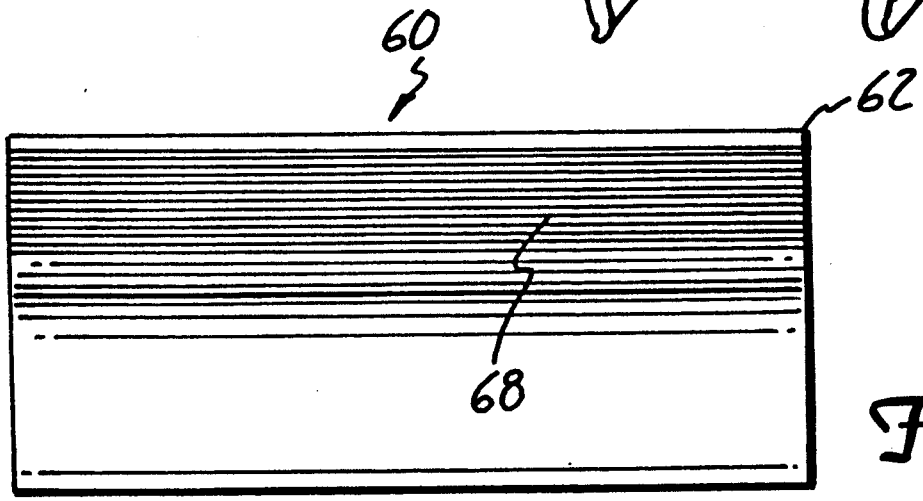
FIG. 15 is a side view of the clamp of FIG. 13.
Figure 14:
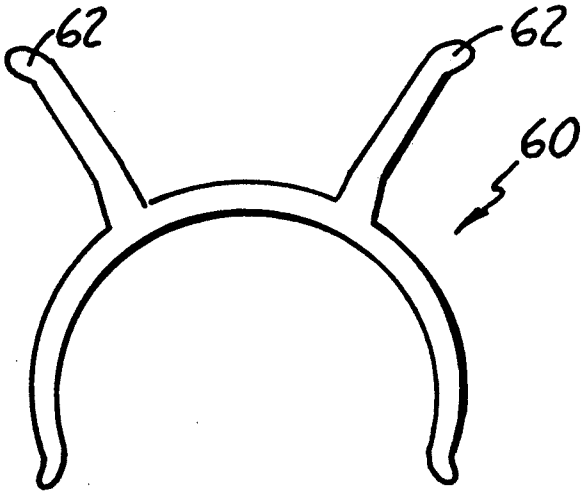
FIG. 14 is an end view of the clamp of FIG. 13.

In the preferred embodiment, the divider 10 also includes clamps 60 that attach to the arms 20 for securing trash receptacle liners 65 to the arms, creating the actual compartments within the trash receptacle. As shown in FIGS. 13–15, the clamps 60 are desirably of a generally semicircular configuration, the radius of which corresponds generally to that of the external member 24 of the arms 20. Extending outwardly from the back of the clamp 60 are two handles 62 which run the entire length of the clamp 60. The outer surface of these handles may have serratations 68 or a roughened surface to enhance one's grip and prevent slippage. The handles 62 are spaced at an appropriate distance from each other to allow for their manual grasping and squeezing. Squeezing the handles 62 causes the ends of the clamp to further separate. When the ends of the clamp are thus separated, the clamp 60 can be positioned or removed from the arm 20. The ends of the clamp 60 are desirably tapered to facilitate the urging of the clamp 60 over the arms 20 without tearing the liners 65.

In actual use, the consumer first decides which of the separate configurations he or she desires. The connector 30 is then correspondingly oriented and the arms 20 attached in the proper direction that will result in the chosen configuration. If the consumer desires three equal sized sections, the three telescopic arms 20 are attached to the three equi-planar plugs 32*a*, 32*b* and 32*c* on the connector 30 and the divider is oriented as shown in FIG. 4. If two large equal sized sections are desired, two of the arms 20 are attached to the two core plugs 32*d* and 32*e* on the connector 30 and the divider is oriented as shown in FIG. 3. For one large section and two smaller equal sized sections, two arms 20 are again attached to the core plugs 32*d* and 32*e*. The divider is then oriented as shown in FIGS. 1–2 so that the third arm can be attached to one of the other plugs 32*a b* or *c*.

The divider 10 may then be placed across the opening of the top of the trash receptacle with the end clips 40 (which typically will be already attached to the arms) engaging the rim of the trash receptacle. The arms 20 may be adjusted to fit the rim of the trash receptacle by sliding the internal members 22 outwardly away from the external members 24 until the end clips 40 fit over the rim of the trash receptacle.

Trash receptacle liners, such as plastic garbage bags, are then placed within each compartment and held open by fastening the top of the liner to the arms 20 with a clamp 60, as shown in FIG. 1. The liners can also be secured to the trash receptacle by running the liner underneath the end clips 40. Liners can be independently removed and replaced as needed.

While a preferred embodiment of the present invention has been described, it should be understood that various changes, adaptations and modifications may be made therein without departing from the spirit of the invention and the scope of the appended claims.

What is claimed is:

1. Apparatus for dividing a trash receptacle of the type having an upwardly open rim into a plurality of sections, comprising:

a plurality of elongated telescopic arms, each having first and second ends and being independently telescopically adjustable to vary its length from the first end to the second end;

securing means carried by the first ends of the arms for securing the arms to the rim of the receptacle;

connector means for attaching and supporting the second ends of the arms with respect to one another, the connector means being generally centrally located so that the arms emanate radially outward from their second ends at the connector means to their first ends at the rim of the receptacle; and means for positioning trash receptacle liners with respect to the arms to provide a plurality of sections.

2. The divider of claim 1 wherein the positioning means comprises clamps for pinning the liners to the arms.

3. The divider of claim 1 wherein the securing means comprises a U-shaped clip for securing the first end of the arms to the trash receptacle rim.

4. The divider of claim 1 wherein the telescopic arms are further comprised of an internal and external member; the internal member being slidably extendable from the external member.

5. The divider of claim 1 wherein the connector means and second ends of the arms include adaptor means for attaching the connector means and second ends of the arms together.

6. The divider of claim 5 wherein the adaptor means comprises a plurality of male-type plugs extending from the connector means and a complementary female-type receiving port carried by each of the second ends of the arms for receiving one of the male-type plugs.

7. Apparatus for dividing a trash receptable of the type having an upwardly open rim into a plurality of sections, comprising:

a plurality of elongated telescopic arms, each having first and second ends;

securing means carried by the first end of the arms for securing the arms of the rim of the receptacle;

connector means for attaching and supporting the second ends of the arms with respect to one another, the connector means and second ends of the arms including adaptor means for attaching the connector means and second ends of the arms together, the adaptor means comprising a male-type plug extending from the second end of each of the arms and a plurality of corresponding female-type receiving ports carried by the connector means for receiving the male-type plugs; and means for positioning trash receptacle liners with respect to the arms to provide a plurality of sections.

8. Apparatus for dividing a trash receptacle of the type having an upwardly open rim into a plurality of sections, comprising:

a plurality of elongated telescopic arms, each having first and second ends;

securing means carried by the first end of the arms for securing the arms to the rim of the receptacle;

connector means for attaching the supporting the second ends of the arms with respect to one another, the connector means and second ends of the arms including adaptor means for attaching the connector means and second ends of the arms together, the adaptor means comprising of a plurality of male-type plugs extending from the connector means and a complementary female-type receiving port carried by the second ends of the arms for receiving the male-type plugs, the male-type plugs of the connector means being further comprised of two intersecting perpendicular walls forming an X thereby; and means for positioning trash receptacle liners with respect to the arms to provide a plurality of sections.

9. Apparatus for dividing a trash receptacle of the type having an upwardly open rim into a plurality of sections, comprising:

a plurality of elongated telescopic arms, each having first and second ends;

securing means carried by the first end of the arms for securing the arms to the rim of the receptacle;

connector means for attaching and supporting the second ends of the arms with respect to one another, the connector means and second ends of the arms including adaptor means for attaching the connector means and second ends of the arms together, the adaptor means comprising of a plurality of male-type plugs extending from the connector means and a complementary female-type receiving port carried by the second ends of the arms for receiving the male-type plugs, three of the plugs being equi-planar, and the other two plus being a constant distant from each of the equi-planar plugs; and means for positioning trash receptacle liners with respect to the arms to provide a plurality of sections.

10. Apparatus for dividing a trash receptacle of the type having an upwardly open rim into a plurality of sections, comprising:

a plurality of elongated telescopic arms, each having first and second ends;

securing means carried by the first end of the arms for securing the arms to the rim of the receptacle;

connector means for attaching and supporting the second ends of the arms with respect to one another, the connector being multi-directional so that the trash receptacle can be sectioned into compartments of different sizes and numbers; and means for positioning trash receptacle liners with respect to the arms to provide a plurality of sections.

11. Apparatus for dividing a trash receptacle of the type having an upwardly open rim into a plurality of sections, comprising:

a plurality of elongated telescopic arms, each having first and second ends;

securing means carried by the first end of the arms for securing the arms to the rim of the receptacle;

a generally central connector for attaching and supporting the second ends of the arms with respect to one another, the connector including a plurality of first male/female-type members extending from the connector and a second complimentary male/-female-type member carried by the second end of each arm for engaging the first male/female-type member; the plurality of first male-female-type members including three such members oriented within a plane, and two additional such members oriented perpendicluarly to such plane; and means for attaching trash receptacle liners to the arms to provide a plurality of trash receptacle sections.

* * * * *